United States Patent [19]

Morgan et al.

[11] 3,996,083

[45] Dec. 7, 1976

[54] PROCESS FOR MAKING DRAPERIES

[76] Inventors: Ronald Wade Morgan, 9509 Tiverton Way, Louisville, Ky. 40222; David L. Witherspoon, P.O. Box 23182, 2104 Evergreen Road, Anchorage, Ky. 40223

[22] Filed: Jan. 12, 1976

[21] Appl. No.: 648,166

Related U.S. Application Data

[63] Continuation-in-part of Ser. No. 505,619, Sept. 13, 1974, abandoned.

[52] U.S. Cl. ..... 156/92; 156/93; 156/202; 160/348; 160/349 R; 160/387; 160/400; 428/102; 428/126; 428/192

[51] Int. Cl.[2] ..... B32B 7/08

[58] Field of Search ..... 156/91, 93, 92, 202; 160/349 R, 330, 348, 387, 400; 223/30; 428/126, 192, 102

[56] References Cited

UNITED STATES PATENTS 2,351,373 6/1944 Thexton ..... 160/387

2,642,577 6/1953 Sherman ..... 160/330

*Primary Examiner*—Edward G. Whitby
*Attorney, Agent, or Firm*—Wm. R. Price

[57] ABSTRACT

This invention describes a process for applying a reinforcing or stiffening strip such as buckram or PELLON (Reg. trademark of the Pellon Corp., New York, N.Y.) to a panel of drapery material directly without the necessity of premarking, measuring, and stitching. This is accomplished by the step of adhesively securing the strip of reinforcing material to the bottom edge of a drapery panel suspended vertically from the hem end. Thereafter, the panel and the reinforcing strip adhesively secured thereto is folded over itself and the reinforcing strip, sandwiched between the two layers of drapery panel is secured thereto in the form of a reinforced heading. The step of securing the reinforcing strip in sandwiched position between the two layers of paneled material may be by means of stapling, adhesive means or by stitching.

6 Claims, 8 Drawing Figures

FIG.1

PROCESS FOR MAKING DRAPERIES

CROSS REFERENCE TO RELATED APPLICATION:

This application is a continuation-in-part of our previously filed application Ser. No. 505,619, filed Sept. 13, 1974 now abandoned and entitled "MEMBER FOR REINFORCING A SHEET OF MATERIAL".

BACKGROUND OF THE INVENTION

This invention pertains to a process of making draperies. More specifically, the present invention relates to the process of making a reinforced heading for draperies in which the steps of premarking, measuring, and some steps of stitching may be eliminated.

BACKGROUND OF THE PRIOR ART

The conventional procedure in manufacturing draperies, is to attach, side by side, by means of stitching, a sufficient number of vertical widths of material to provide the desired overall width of a main drapery panel, and to finish the top edge and the two vertical side edges, as required. Consequently, in common practice a considerable amount of time has been required to lay the widths of drapery material flat on large tables in a process called "tabling", and to make spaced measurements from the top edge of the drapery, to pin the hem in as the operator works from side edge of the drapery to the other marginal side edge. Additional problems are involved with various types of material in this type of operation due to uneven pulling and stretching of loose woven fabrics and the like. Furthermore, a great deal of floor space has been required to provide for the horizontal surface of such materials since some panels consisting of several widths of material may be ten to twently feet in width. The major improvement in these operations was made by Michael Tuskos in his U.S. Pat. No. 3,439,438, in an operation referred to as "vertical tabling". By use of the apparatus described and claimed in this patent, the panels of drapery material were suspended vertically so that various operations, such as marking, hemming and pressing could be done by use of an extendible ironing board at the bottom. Various catch shelves were provided to mark the panels at various levels so as to provide means for the seamstresses to know where the hems should be placed, where the reinforcing buckram should be sewn in, etc. The improvement disclosed in the Tuskos U.S. Pat. No. 3,738,007 provided for the vertical suspension of the drapery panels so that the materials could be simultaneously marked and trimmed at the bottom by means of a horizontally moving carriage containing a scissors amd marker device which would simultaneously trim and mark at a selected height therefrom a space to allow the seamstresses to later sew in the reinforcing buckram, crinoline or other stiffening material in a subsequent step after the panels were removed from the material. One of the advantages attributed to this device was the elimination of the ironing board and the elimination of the various catch shelves. Creasing the fabric at predetermined distances was no longer necessary since the marker had already marked the fabric so that the seamstress would know where to sew in the reinforcing buckram.

SUMMARY OF THE INVENTION

According to this invention, the buckram is applied directly to the bottom free edge of the vertical suspended panel of drapery material. This can be done either with the ironing board elevated as is shown in the drawings or with the ironing board in a vertical position or indeed, without an ironing board whatsoever. The buckram or other reinforcing material is adhesively secured to the bottom free edge of the suspended drapery panel and thereafter the drapery panel with the reinforcing strip adhesively secured thereto is folded over itself and the two layers and the reinforcing strip sandwiched therebetween are secured into position. This may be accomplished according to one embodiment of this invention by applying pressure sensitive adhesive to both sides of the reinforcing strip or in another embodiment by adhesively securing one side of the buckran to the bottom free edge of the drapery panel and thereafter securing the other side in sandwiched position between the two layers of drapery material by stitching, stapling or the like. One of the advantages attributable to this invention is the elimination of the need to mark the panel, since the step of adhesively securing the buckram strip thereto immediately indicates where the material should be folded. Secondly, this operation can be carried out swiftly so that it can be accomplished while still in position on the vertical frame and the reinforcing strip of buckram can be permanently or temporarily secured into position and sandwiched between the two layers of drapery panel for subsequent stitching. The conventional stitching across the entire width of the panel may be eliminated and only the vertical stitching for provision of pleats is required to hold the buckram in position. Therefore, by provision of a staple or pin or other temporary holding device, the seamstress can then sew in the vertical stitches for provision of the pleats and thereby simultaneously secure the buckram in position between the two layers of drapery panel forming a reinforced heading. This offers two advantages in that it eliminates the unsightly seam line across the top of the drapery and eliminates the tedious and awkward operation of sewing a straight seam along across the entire width of the panel which as indicated, may be as wide as ten to twenty feet.

BRIEF DESCRIPTION OF THE DRAWINGS

Reference is now made to the accompanying drawings wherein.

DESCRIPTION OF THE PREFERRED EMBODIMENT

Figure 1:
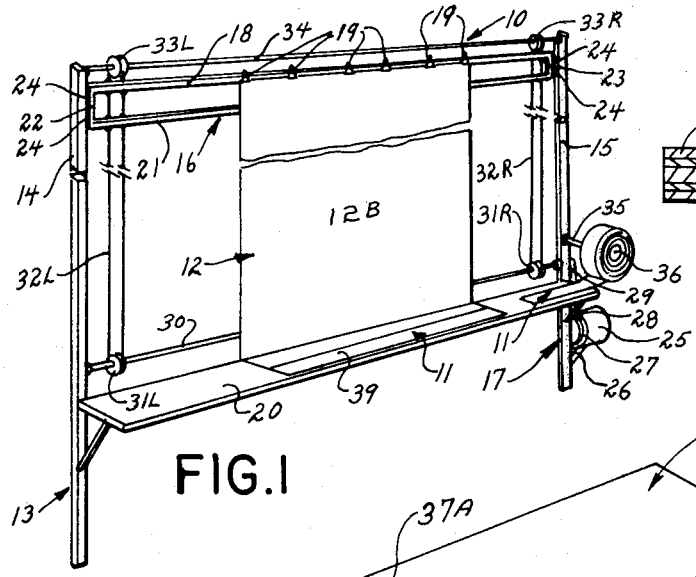
FIG. 1 is a somewhat schematic fragmentary elevational perspective view illustrating a form of the apparatus corresponding generally with the basic Tuskos development described in U.S. Pat. No. 3,439,438, which illustrates the form of the apparatus which can be employed to utilize one form of the present invention.
Figure 3:
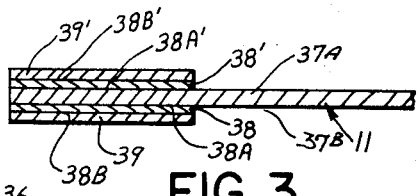
FIG. 3 is a greatly enlarged fragmentary sectional view taken along lines 3 — 3 of FIG. 2.

Referring now to the drawings, and more particularly, to FIG. 1 thereof, there is illustrated a form of the apparatus 10 which may be employed to practice the process of this invention. As will be seen, this apparatus resembles in some detail, the device illustrated and described in Tuskos patent, U.S. Pat. No. 3,439,438 with the addition of a spool 36 of a strip of reinforcing buckram 11 supported on spindle 35. The process may be practiced as illustrated with the ironing board 20 in horizontal position, or with the ironing board completely eliminated. In this event, the positioning of the spool 36 of buckram 11, supported on spindle 35 would have to be readjusted so as to feed directly onto the bottom edge, of the panel of drapery material 12. This, then, would place the spool 36 in a horizontal position rather than in the vertical position shown in the drawing in FIG. 1.

Nevertheless, as illustrated, the apparatus 10 includes an upstanding frame 13, having first and second spaced, vertical plane defining parallel guide track mounting members 14 and 15 and a trolley 16 which transversely spans the space between the vertical members 14 annd 15 and is movably connected thereto for vertical movement with respect to the frame 13 by electrically powered drive means 17. The trolley 16 is generally rectangular in shape and is comprised of at least one transverse member 18 such as that forming its upper edge, which is provided with gripper means in the form of spring clamps 19, to grasp the panel of drapery material 12 by its hem edge and vertically position the lower end of the panel 12 with respect to the ironing board 20, which is hinged to and spans transversely generally horizontally across the lower position of the frame 13 to receive the lower end of the panel 12 that is to be reinforced by the strip of buckram 11 to form a drapery heading. The vertical frame members 14 and 15 are spaced apart by a distance great enough to accomodate the widest panel of the drapery material 12 to be operated upon.

Vertical tracks are provided for the trolley 16 by respectively fixing a pair of channel shaped members to the vertical frame members 14 and 15 by welding or other means to extend downwardly from the top thereof. The generally rectangular shaped trolley 16 is vertically arranged on the front of the frame 13 and preferably included a second transverse member 21 which is spaced apart from and parallel to its other transverse member 18 and thus forms its lower edge. The two transverse members 18 and 21 of the trolley 14 are interconnected by a pair of side members 22 and 23 that respectively forms its left and right edges. Each of these side members 22 and 23 of the trolley 14 is provided with rollers 24 that are engaged in the vertical tracks respectively provided on the frame members 14 and 15.

As further illustrated in FIG. 1, the drive means 17, for the trolley 16, comprises a reversible rotary electric motor 25 that has its housing fixed to a bracket member 26 which extends from the right vertical frame member 15 and a lower elevation than the board 20. The motor 25 has a rotary output shaft connected with a sheave 27 which is interconnected by a belt 28 to another sheave 29 that is mounted on the right end of a trolley drive shaft 30. The trolley drive shaft 30 extends horizontally between the left and right vertical frame members 14 and 15 and is rotably journaled therein. The trolley drive shaft 30 is provided with sprockets 31 L and 31 R adjacent its opposite left and right ends and these sprockets 31 L and 31 R are respectively connected by left and right trolley drive chains 32 L and 32 R to other sprockets 33 L and 33 R that are provided on the opposite side left and right ends of a driven shaft 34. The driven trolley shaft 34 extends across the top of the frame 13 and is rotatably journaled in the tops of the left and right frame members 14 and 15. One end of each of the two trolley drive chains 32 L and 32 R is respectively connected to the left or right bottom of the trolley 16 while the opposite end of each chain 32 L and 32 R is respectively connected to the left and right top corner of the trolley 16. With this arrangement, rotation of the motor output sheave 27 in a first direction will cause upward movement of the trolley 16 relative to the frame 13, whereas rotation of the motor output shaft sheave 27 in an opposite direction will cause downward movement of the trolley 16 relative to the frame 13. The apparatus 10 is also provided with control means, not shown, for de-energizing the trolley drive means 17 following upward movement of the trolley to a predetermined distance above the board 20.

As further shown in FIG. 1, the apparatus 10 is provided with a spindle 35 which is attached to and protrudes forwardly from the right vertical frame member 15 at an elevation higher than the board 20 that rotatably journals a spool 36 by which there is wound a quantity of buckram or other reinforcing material 11 that is used in accordance with the present invention.

Figure 2:
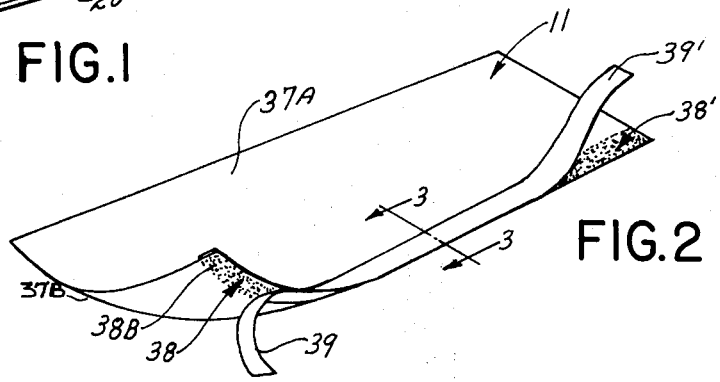
FIG. 2 is an enlarged fragmentary view showing details of the construction of one form of the reinforcing member which may be utilized in this invention.
Figure 4:
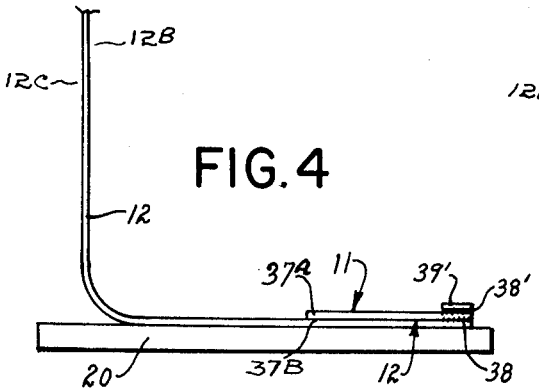
FIG. 4 is a greatly enlarged fragmentary schematic left end elevational view of the portion of the apparatus of FIG. 1, illustrating the use of the reinforcing member in the first step of the process of this invention.
Figure 8:
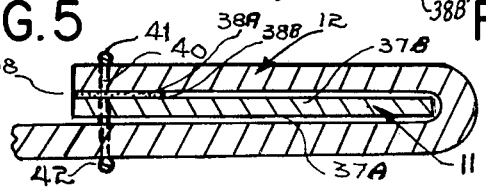
FIG. 8 is a sectional view of a modification of the present invention, wherein temporary stapling means are utilized to secure the reinforcing strip in sandwiched position between the two layers of drapery panel.

As is best shown in FIGS. 2 through 7, the stiffening or reinforcing material 11 in the form of buckram or PELLON, has a first face 37 A and a second face 37 B. As is illustrated in FIG. 2, the first face 37 A is coated with an adhesive coating, 38′ whereas the second face, 37B of the buckram strip 11 has an adhesive coating 38. The surface 38B of the adhesive coating 38 is protected by means of a removable coating strip 39 which is partially pulled away in FIG. 2. The surface 38A and 38A′ are adjacent to the first and second faces 37A and 37B of the buckram strip 11 respectively. While is should be understood that various other forms of adhesives might also be employed for adhesive coatings 38 and 38′, which have one of their surfaces 38 and 38A′ fixed to opposite sides of the opposite faces 37A and 37B of the reinforcing buckram strip 11, good results have been obtained by utilizing an elastmeric base adhesive of a type readily found commercially available from the 3 M Company of St. Paul, Minnesota. Further, it is not necessary, as will be described in more detail later, to utilize a pressure sensitize adhesive on both faces 37A and 37B of the buckram strip 11 since it is necessary only to adhesively secure one side of the buckram strip 11 to the bottom free edge of the back surface 12B of the drapery panel 12. Further, it is within the scope of this invention to apply adhesive directly to the reinforcing strip of buckram 11 or directly to the back surface 12B of the panel of drapery 12 along the bottom free edge of the drapery panel 12. The sequence of steps of the invention require: first, that the one face 37A or 37B, be adhesively secured to the bottom free edge of the back surface 12B of the drapery panel 12 and thence that reinforcing strip 11 adhesively secured to the panel be folded over upon itself so as to sandwich the reinforcing strip 11 of buckram between the two back surfaces of the drapery panel 12 and thence to secure same into position. As is illustrated in FIG. 8, this may be by means of a staple or pin 40, which can be utilized; and can be thereafter removed when the strip of buckram 11 is permanently secured into place by stitching. As further previously indicated, the stitching need not be across the whole width of the reinforced heading, as has been conventional practice, but may be through the vertical stitches utilized subsequently to make pleats. Therefore, according to this invention, the unsightly horizontal seam across the upper edge of the heading member is eliminated, as is the tedious and awkward operation of placing said seam across the entire width of the panel member 12.

Further, since the stitches are conventionally placed into the reinforced heading, for provision of pleats, this operation simultaneously anchors and secures the reinforcing strip 11 of buckram or PELLON into position and the staples or pins can thus be removed.

In utilizing the illustrated form of the strip of buckram 11 of the present invention with the illustrated apparatus 10, an operator first connects normally the hem edge of the sheet of the panel of drapery material 12 to the upper end 18 of the trolley 16 with the spring clamps 19 that are provided for that purpose. Then, he energizes the motor 25 of the trolley drive means 17 to cause the trolley 16 to move upwardly relative to the frame 13 to a height sufficiently high to dispose a sufficient amount of the lower edge of the panel of material. The ironing board 20 thence, can be placed or moved upward into the horizontal position so as to provide the bottom free edge of the drapery panel 12 into position for application of the strip 11 of reinforcing buckram member. Thereafter, the operator pulls the leading edge of the buckram member 11 outwardly and leftwardly as shown in FIG. 1, across the entire width of the back surface of the panel member 12 while matching the forward edges with the bottom free end of the panel member 12. Thereafter, the operator severs the withdrawn portion of the strip of buckram 11 from the storage spools 36 by cutting it with scissors or the like. Thereafter, the operator manually removes the protective covering 39 from the bottom side of the dispensed portion of the reinforcing buckram strip 11 to cause the surface 38B of the adhesive coating to adhere to the back surface of the left end of the horizontally arranged panel of material 12 supported on the horizontal board 20. The operator thereafter, continues to remove the protective strip while adhesively securing the bottommost edge of the adhesive covering 38b to the back surface 12B of panel 12 until the Bottom free edge is completely covered. If the two faced pressure adhesive surfaces 38 and 38B are utilized as is illustrated in the Figures, the second covering strip 39 is manually removed from the adhesive surface 38' which leaves the member and the panel 12 in the condition shown in sheet 5.

Figure 6:
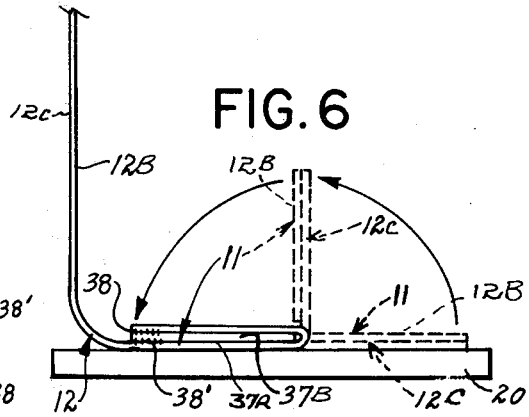
FIG. 6. is a view similar to that shown in FIG. 4 but illustrating the second and third steps of the present invention; and, FIG. 7 is another enlarged fragmentary elevational cross section of a portion of FIG. 6, illustrating the reinforcing member sandwiched between the two layers of the drapery material.
Figure 5:
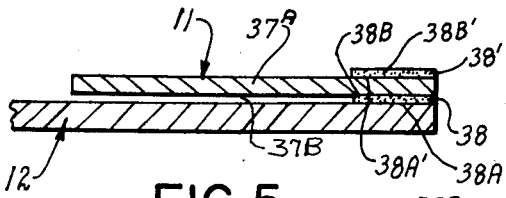
FIG. 5 is another enlarged fragmentary elevational cross sectional view of a portion of FIG. 4.
Figure 7:
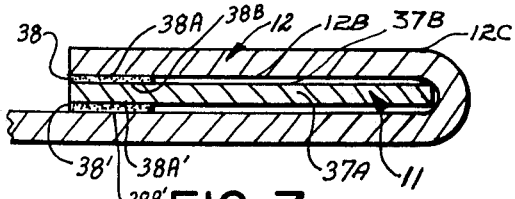

Now, as is shown in FIG. 6, the operator manually folds the foremost portion of the generally horizontal arranged lower edge of the panel 12, substantially 180° above upon the back surface 12B of drapery panel 12 which causes the uncovered surface 38B of the second adhesive coating 38' to be placed into contact with the adjacent surface of the adjacent portion of the back surface 12B of the panel 12 and thus sandwich the reinforcing member 11 between the two layers of drapery fabric.

As previously indicated, it is not necessary however, that the second adhesive coating 38' be utilized. Thus, as is shown in FIG. 8, the second surface 38' can be completely eliminated and the reinforcing strip of buckram 11, sandwiched between the two layers of the drapery panel 12 by removable means such as staples, pins or the like. In this FIG., the shaft of the staple 40 is shown whereas the crimped edges are shown in cross section as 41 and 42. Thereafter, upon removal of the panel 12 from the frame, the operator can place the vertical stitches, normally utilized at spaced intervals for pleats into the reinforced heading, thus securing permantly the buckram strip 11 into position at which time the temporary fastening means in the form of staples, pins or the like can be removed and discarded. This, therefore, completely eliminates the unsightly horizontal seam sometimes encountered in the reinforced headings at the top of the draperies and further eliminates the tedious and time consuming operation of placing said seam into the drapery panel.

Further, it is not necessary that the ironing board be placed into a horizontal position as is presently shown in the drawing or in fact, that an ironing board be used whatsoever. Since the adhesive need not be thermally sensitive, it is not necessary to apply heat thereto and in fact it is not necessary to use a pressure sensitive adhesive since other forms of adhesive can be applied directly to the roll of material as it is dispensed onto the bottom surfaces of the panel of drapery material.

Further, it is not necessary that both sides of the strip 11, of the reinforcing buckram be adhesively coated to the suspended drapery panel.

While many modifications will occur to those skilled in the art from the detailed description hereinabove given, which is meant to be exemplary and non-limiting, in scope, such modifications are intended to fall within the spirit and scope of the invention, except so as to be commensurate in scope with the appended claims.

We claim:

1. In a process for making draperies, wherein one or more widths of material are sewed to form a panel, the improvement of making a reinforced heading for said panel, which comprises:

A. suspending a panel of drapery material vertically from the hem end, with the back surface of said panel facing forwardly, B. placing the first face of a strip of reinforcing material, having first and second faces, on said back surface of said panel along the bottom free edge of said panel;

C. adhesively securing said first face of said strip of reinforcing material to the back surface of said panel;

D. folding said panel of material with said strip of reinforcing material adhesively secured thereto over itself so that the strip of reinforcing material is sandwiched between two layers of said panel, the other face of said strip lying in contact with the adjacent portion of the back surface of said panel;

1. securing said strip of reinforcing material and said two layers of said panel together to form a reinforcing heading for said drapery panel.

2. A process as defined in claim 1, in which said step of securing said strip of reinforcing material and said two layers of panel together involves the step of applying temporary fastening means thereto.

3. A process, as defined in claim 2, in which said step of applying temporary fastening means involves stapling.

4. A process, as defined in claim 2, in which said reinforcing strip is permanently secured to said two layers of panel by the step of subsequently stitching said strip to said two layers of drapery panel.

5. A process, as defined in claim 4, in which said subsequent stitching step is vertically disposed relative to said reinforced heading and additionally provides pleats in said reinforced heading.

6. A process, as defined in claim 4, the step of removing said temporary fastening means after the reinforcing strip is permanently secured.

* * * * *